US006397411B1

(12) United States Patent
Messina

(10) Patent No.: US 6,397,411 B1
(45) Date of Patent: Jun. 4, 2002

(54) DIVAN BED WITH MOVABLE FRAME HAVING MEANS FOR RESTING ON THE GROUND WHICH CAN BE EXTRACTED/ RETRACTED BY MEANS OF ROTATIONAL OPERATION

(75) Inventor: Rosario Messina, Seregno (IT)

(73) Assignee: Flou S.p.A., Meda (IT)

( * ) Notice: Subject to any disclaimer, the term of this patent is extended or adjusted under 35 U.S.C. 154(b) by 0 days.

(21) Appl. No.: 09/547,750

(22) Filed: Apr. 12, 2000

(30) Foreign Application Priority Data

Apr. 12, 1999 (IT) ..... MI99A07390

(51) Int. Cl.[7] ..... A47C 17/13
(52) U.S. Cl. ..... 5/21; 5/18; 5/55.1
(58) Field of Search ..... 5/17, 18.1, 21, 5/55.1

(56) References Cited

U.S. PATENT DOCUMENTS 1,520,931 A * 12/1924 Chessler ..... 5/21
2,146,864 A * 2/1939 Stauffer et al. ..... 5/18.1
2,151,257 A * 3/1939 Wuest et al. ..... 5/18.1
2,164,438 A * 7/1939 Woller ..... 5/21
2,744,266 A * 5/1956 Kaehn ..... 5/18.1
3,855,650 A * 12/1974 Neunherz et al. ..... 5/21
3,877,087 A 4/1975 Harty ..... 5/13
4,166,299 A 9/1979 DuShane et al. ..... 5/18

FOREIGN PATENT DOCUMENTS

DE 9011737 10/1990

* cited by examiner

*Primary Examiner*—Michael F. Trettel
(74) *Attorney, Agent, or Firm*—Baker Botts LLP

(57) ABSTRACT

Divan bed comprising a fixed frame (1) which has a movable frame (2) sliding inside it, said fixed frame (1) having longitudinal sections (10) forming, inside them, longitudinal guides (11,12) inside which corresponding means (33) for engaging the movable frame (2) are able to slide, there also being provided elements **(23,23*a*) for resting the movable frame (2) on the ground, which rotate from a raised position to a lowered position and vice versa when the movable frame (2) is in the position extracted from/inserted inside the fixed frame (1), and associated means (40) for operating and actuating said elements (23)** for resting on the ground.

18 Claims, 2 Drawing Sheets

Fig. 3
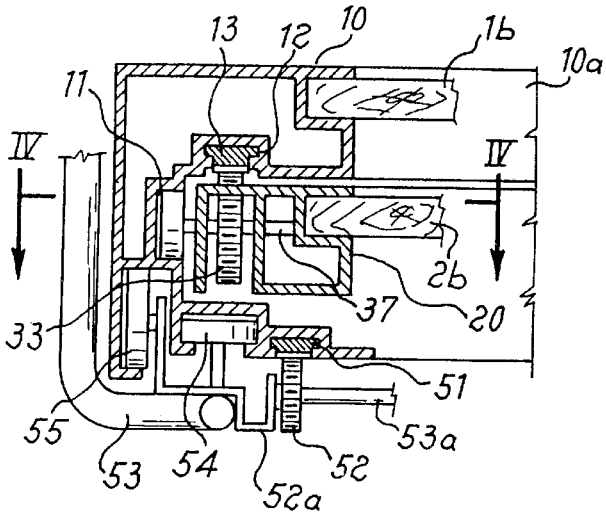
Fig. 4
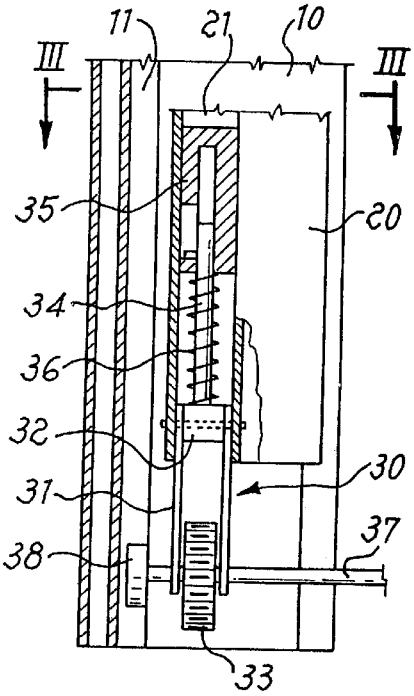
Fig. 5
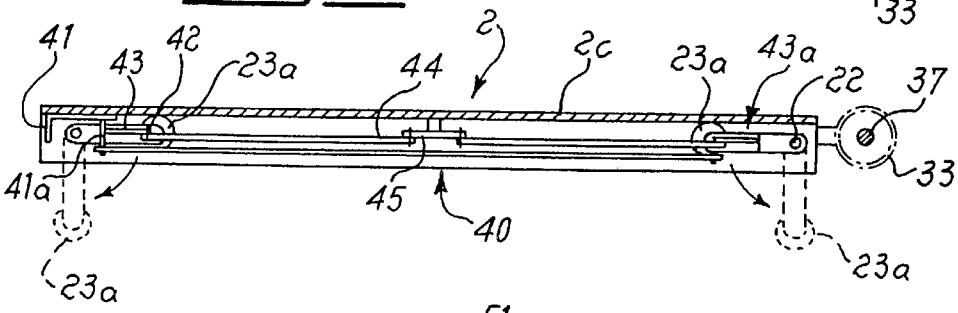
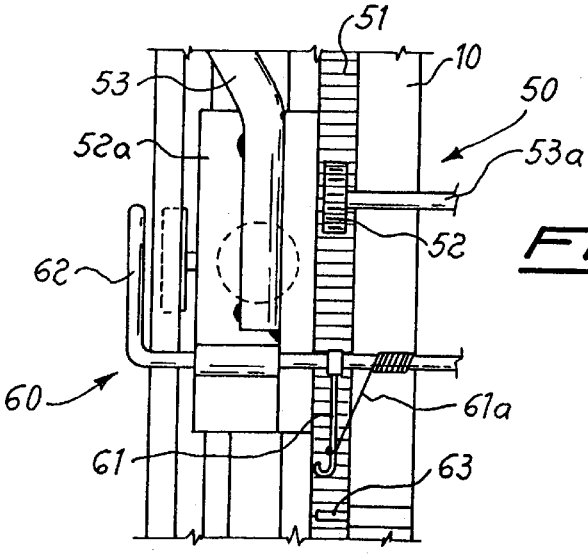
Fig. 6

DIVAN BED WITH MOVABLE FRAME HAVING MEANS FOR RESTING ON THE GROUND WHICH CAN BE EXTRACTED/ RETRACTED BY MEANS OF ROTATIONAL OPERATION

The present invention relates to a divan bed comprising a fixed frame which has, sliding inside it, a movable frame provided with elements for resting on the ground, which rotate from a raised position to a lowered position and vice versa when the movable frame is in the position extracted from/inserted inside the fixed frame, there being provided associated operating and actuating means.

It is known in the art relating to the production of divans and/or divan beds that there is the need to have mechanisms with a simple and a low-cost design which are able to vary the configuration of the divan, so that the latter can be converted from the normal closed arrangement into a position where it is totally extended in the form of a bed.

Numerous types of mechanisms which are able to achieve said conversion from a divan to a bed and vice versa are also known. They have, however, certain drawbacks including the difficulty involved in operating them, in particular by users who are inexpert or have a limited amount of physical force.

In the case of a variation in the configuration obtained by means of relative translation of two flat frames, said difficulty with regard to operation is also due to the fact that the movable frame is not kept parallel to the fixed frame during movement, and the consequent tendency of the former to rotate with respect to the latter causes jamming with consequent interruption in the sliding movement.

The technical problem which is posed, therefore, is to provide a divan bed with a frame which has a simple and functional structure and which allows extraction of its movable part by means of a single movement which can be performed without excessive force by the user.

Within the scope of this problem, a further requirement is that the movable part of the frame should not have the tendency to rotate during extraction, avoiding jamming and locking of the extractable part, and that it should also have means designed to allow the movement of the backrest of the divan so as to adjust the length of the seat in relation to the specific use thereof.

These technical problems are solved according to the present invention by a divan bed comprising a fixed frame having a movable frame sliding inside it, said fixed frame having longitudinal sections forming, inside them, longitudinal guides inside which corresponding means for engaging the movable frame are able to slide, there also being provided elements for resting the movable frame on the ground, which rotate from a raised position to a lowered position and vice versa when the movable frame is in the position extracted from/inserted inside the fixed frame, and associated means for operating and actuating said elements for resting on the ground.

Further details may be obtained from the following description of a non-limiting example of embodiment of the invention provided with reference to the accompanying drawings in which:

FIG. 3 shows: a partial cross-section along the plane indicated by III—III according to FIG. 4;

FIG. 4 shows: a partial cross-section along the plane indicated by IV—IV according to FIG. 3;

FIG. 5 shows: a partial cross-section along the plane indicated by V—V according to FIG. 2; and FIG. 6 shows: a bottom view of the fixed frame with the mechanism for moving and locking the backrest of the divan.

Figure 1:
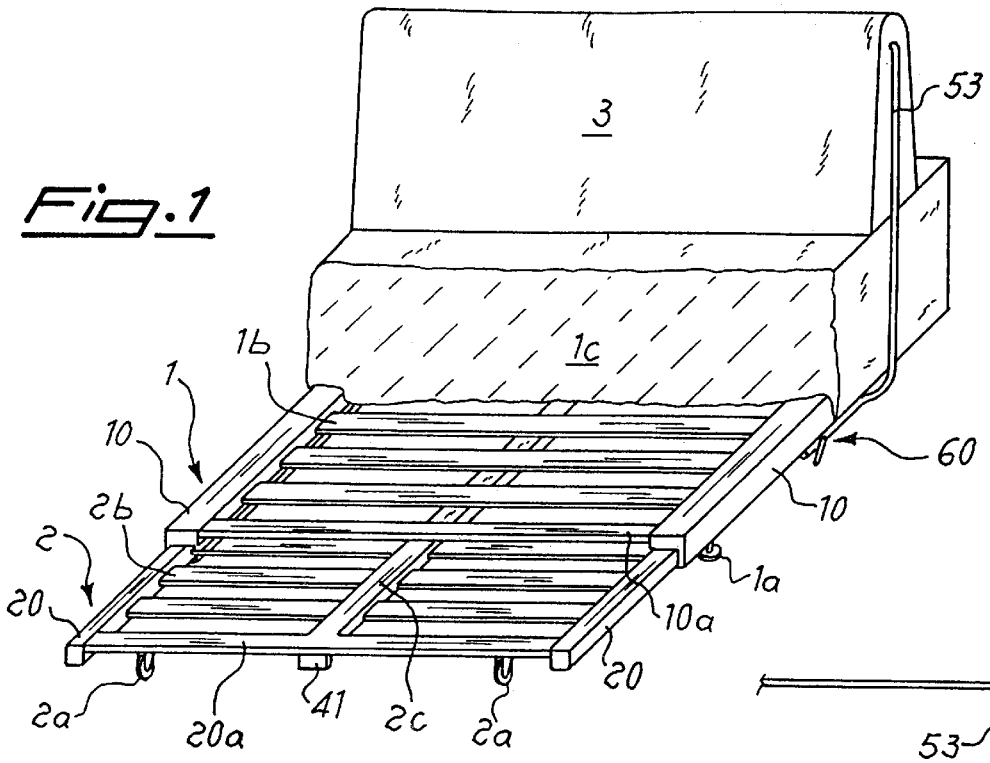
FIG. 1 shows: a schematic perspective view of a divan bed according to the present invention.

As illustrated, the divan bed according to the invention has a fixed frame part 1 which rests on the ground by means of associated feet 1*a* and which is provided with slats 1*b* for supporting the upholstery forming the seat 1*c*.

A movable frame 2 is able to slide telescopically outwards/inwards on said fixed frame 1 and is in turn provided with slats 2*b* and, once extracted, transforms the divan into a bed.

In greater detail, the fixed frame 1 consists of two longitudinal sections 10 which are connected together in the transverse direction by bracing cross-pieces 10*a*.

The sections 10 have inside them (FIG. 3) a first longitudinal seat 11 and a second longitudinal seat 12 containing a fixed rack 13 designed to engage with corresponding means of the extractable frame part 20 which are described in detail further below.

The movable frame 2 is in turn formed by two longitudinal sections 20 which have a cross-section suitably matching that of the sections 10 so that they may be telescopically inserted therein; the two longitudinal sections 20 are also connected in the transverse direction by bracing cross-pieces 20*a*, the front one of which supports two small wheels 2*a* which travel on the ground.

The sections 20 have a longitudinal seat 21 receiving an articulated arm 30 supporting a cog wheel 33 designed to mesh with the rack 13 of the fixed frame 10.

Said articulated arm consist of a forked member 31, one end of which supports the said cog wheel 33 and the other end of which is pivotably mounted on a block 32 integral with one end of a rod 34 movable in a translatory manner inside the seat 21 and an end-of-travel element 35.

A spring 36 which reacts against the block 32 and the end-of-travel element 35 is arranged coaxially with respect to the rod 34.

The cog wheels 33 are connected together in the transverse direction (FIG. 4) by a shaft 37 which extends from both the opposite ends beyond the cog wheels 33 so as to support two additional guide rollers 38 which roll inside said longitudinal seat 11 of the fixed section 10.

In this way the movable frame 2 is guided without play during its translatory movement for extraction/reinsertion, rotation thereof and therefore jamming and interruption in its movement being prevented.

Figure 2:
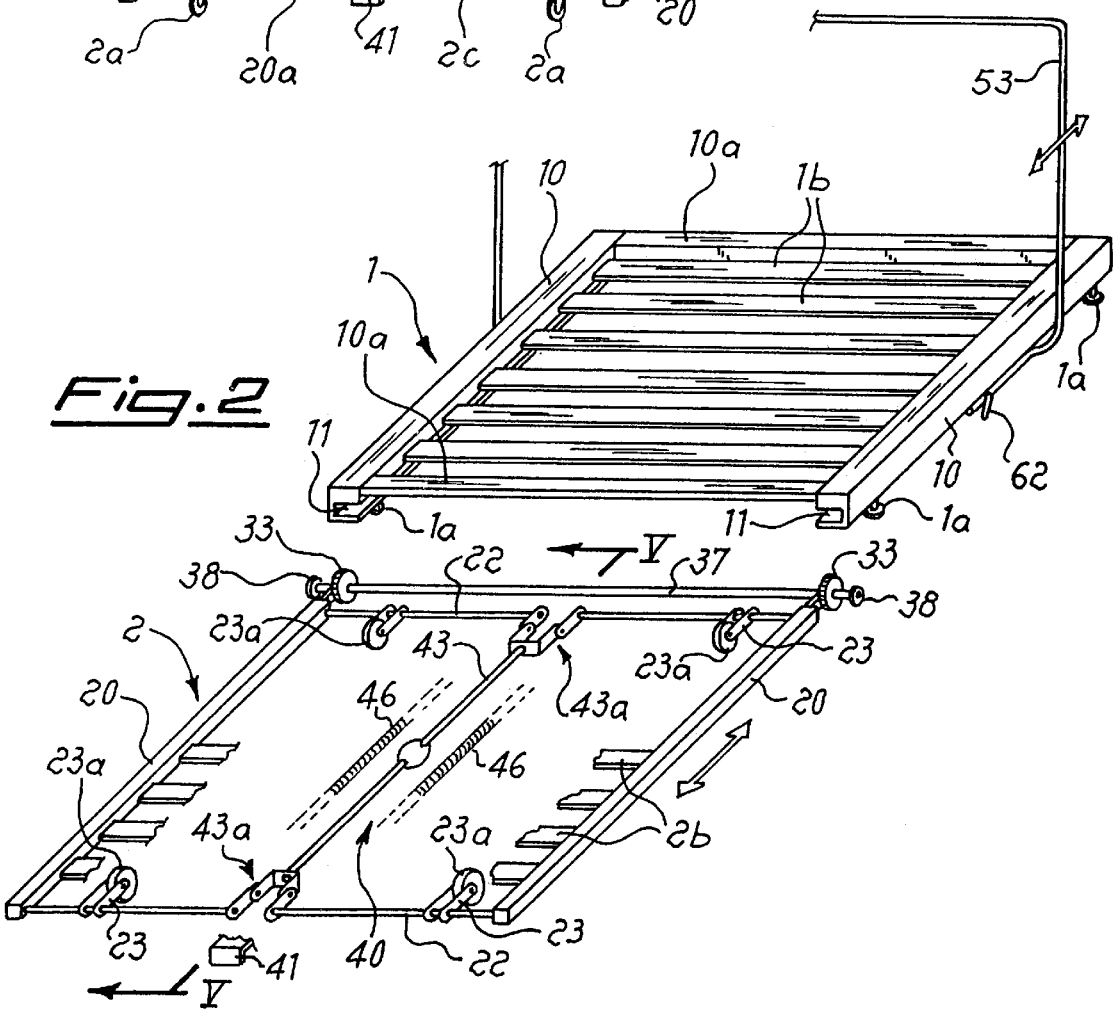
FIG. 2 shows: an exploded view of the telescopic frame of the divan according to FIG. 1.

Two transverse bars 22 which are rotationally connected to the said sections are also located between the longitudinal sections 20 of the movable frame 2 (FIG. 2); two feet 23 with a roller 23*a* at their free ends are respectively fixed to said bars 22.

Said feet 23 rotate together with the said bars 22 from a position rotated inwards with the feet raised substantially parallel to the ground (FIG. 2) to a position rotated outwards with the feet extracted and inclined so as to rest on the ground (shown in broken lines in FIG. 5).

Rotation of the two bars 22 supporting the feet 23 is performed by means of associated actuating means 40 consisting of a mechanism fastened to a longitudinal support 2*c* integral with the movable frame 2.

Said mechanism, when actuated by means of a translatory movement imparted by a handle 41 which is arranged in the front part of the frame 2 and can be operated by the user, is able to convert said translatory movement into a rotational movement of the two bars 22.

In a preferred example of embodiment, the handle 41 is connected to one end of a first rod 41*a*, the other end of which is linked by means of a pin 42 to a second rod 43 joined to a forked member 43*a* forming a connecting rod connected by means of a crank to the rear rod 22.

The said pin 42 also has, pivotably mounted on it, a third rod 44, the other end of which is joined to a rotating cam 45.

The mechanism is symmetrically provided on the opposite side of the cam so as to impart a similar actuating movement to the front bar 22.

At least one suitably tensioned spring 46 is provided between the handle 41 and the fixed part of the mechanism 40, said spring recalling the handle 41, the bars 22 and the feet 23 into the initial rest position when the movable frame 2 is re-inserted into the fixed frame 1.

As illustrated in FIGS. 3 and 6, the rear part of each section 10 of the fixed frame 1 has, fixed to it, an additional rack 51 which meshes with a cog wheel 52 mounted on a pin integral with a shaped element 52*a* to which the following are also fastened: a shaped tubular element 53 supporting the backrest 3, a first wheel 54 with a vertical axis and a second wheel 55 with a horizontal axis, travelling in associated longitudinal seats of the section 10*a*.

With these guide elements, the tubular element 53 may be displaced by means of a translatory movement into positions which are more or less advanced with respect to the seat so as to shorten/length the latter in relation to the position which the user wishes to assume, i.e. seated or with his/her legs raised and extended.

Since the two cog wheels 53 are connected together in the transverse direction by a shaft 53*a*, the backrest is guided during its translatory movement in both directions without the possibility of rotation with respect to the fixed frame, thus ensuring an easy and reliable forwards/backwards positioning movement.

The mechanism is completed by means 60 for locking the sliding movement, consisting of a hook 61 rotatable against the recall action of a spring 61*a* upon operation of an external handle 62 accessible to the user; the hook 61 is designed to be fastened onto a transverse pin 63 arranged in one or more suitable positions along the fixed section 10, thus defining one or more positions for locking the backrest and therefore corresponding lengths of the seat.

The operating principle of the divan bed is as follows: during conditions of normal use as a divan, the movable frame 2 is totally inserted inside the fixed frame 1 and support on the ground is provided by the feet 1*a* of the fixed frame 1 and by the wheels 2*a* of the movable frame 2.

When the user wishes to convert the divan into a bed, he/she pulls the handle 41 towards him/her and starts to pull out the movable frame 2 which is extracted, resting on the wheels 2*a*, and, as it emerges, releases the front feet 23 from the fixed guide 10 so that the said feet are able to rotate outwards and be arranged in position resting on the ground; as extraction of the movable frame continues, the rear feet 23 are also released and, rotating together with the rear bar 22, in turn assume the position where they are resting on the ground.

At this point the movable frame continues its extraction movement resting on the feet 23, the end rollers 23*a* of which, rolling on the ground, allow extraction.

The length of the feet 23 is envisaged such that, when the said feet are resting on the ground, the movable frame is raised by an amount such as to bring it level with the fixed frame 1 and form a continuous base for the bed; the wheels 2*a* for supporting the movable frame on the ground are correspondingly shorter so that, once the frame has been extracted, the said wheels are raised, whereas they make supporting contact again during re-insertion of the movable frame, where the feet 23 return into their position rotated upwards and the movable frame is lowered again so as to the retracted inside the fixed frame underneath the plane of the upholstery.

During extraction/insertion and the corresponding changes in height of the movable frame, the cog wheels 33 remain engaged with the rack 13 owing to rotation of the articulated arm 31.

The various parts may be subject to many variations: in particular it is possible to provide the movement of the feet 23 in the same direction of rotation, instead of in a counter-rotating manner as described above.

This simplifies considerably the mechanism for actuating the two bars 22 since it is no longer necessary to reverse one of the two rotating movements.

In the claims:

1. A divan bed comprising:

a fixed frame which has a movable frame sliding inside it, wherein said fixed frame has longitudinal sections forming, inside them, longitudinal guides inside which means for engaging said movable frame are able to slide;

a rack arranged inside at least one of said longitudinal guides of each section;

elements for resting said movable frame on a ground, said elements for resting said movable frame on said ground rotating from a raised position to a lowered position and vice versa when said movable frame is in a position extracted from/inserted inside said fixed frame; and means for operating and actuating said elements for resting said movable frame on said ground.

2. The divan bed according to claim 1, wherein said movable frame supports cogwheels designed to engage with said rack.

3. The divan bed according to claim 2, wherein said cogwheels are connected in a transverse direction by a spacer bar.

4. The divan bed according to claim 3, wherein said spacer bar is pivotably mounted on arms articulated with a respective section of said movable frame.

5. The divan bed according to claim 3, wherein a roller is mounted on a shaft for rotation of said cogwheels, said roller travelling inside a respective longitudinal guide of a fixed section.

6. A divan bed comprising:

a fixed frame which has a movable frame sliding inside it, wherein said fixed frame has longitudinal sections forming, inside them, longitudinal guides inside which means for engaging said movable frame are able to slide;

two bars, said two bars being arranged between said longitudinal sections of said movable frame and rotating in two directions upon operation of respective means for rotating each of said two bars;

elements for resting said movable frame on a ground, said elements for resting said movable frame on said ground rotating from a raised position to a lowered position and vice versa when said movable frame is in a position extracted from/inserted inside said fixed frame; and operating means for operating and actuating said elements for resting said movable frame on said ground.

7. The divan bed according to claim 6, wherein said bars comprise feet connected to said bars, said bars rotating therewith from a raised position substantially parallel to said ground into a position inclined downwards for resting on said ground.

8. The divan bed according to claim 7, wherein said feet support rollers at their free ends.

9. The divan bed according to claim 7, wherein said movable frame has a pair of wheels for resting on said ground when said movable frame is retracted inside said fixed frame.

10. The divan bed according to claim 9, wherein said wheels for resting on said ground are shorter than said feet when the latter are in the extracted position.

11. The divan bed according to claim 7, wherein said means for operating and actuating said elements for resting said movable frame on said ground comprises a handle movable in a translatory manner and a transmission designed to convert a translatory movement of said handle into a rotational movement of said bars.

12. The divan bed according to claim 11, wherein said rotation of said bars is in opposing directions.

13. The divan bed according to claim 12, wherein said transmission comprises at least one cam on which levers for connection to said bars are pivotably mounted.

14. The divan bed according to claim 7, wherein said means for operating and actuating said elements comprise resilient means for recalling said bars into a rest position with said feet raised.

15. The divan bed according to claims 1 or 6, wherein said movable frame comprises longitudinal sections which can be telescopically inserted inside section of said fixed frame.

16. The divan bed according to claim 1 or 6, further comprising a backrest provided with means for translatory movement and locking said backrest relative to a seat.

17. The divan bed according to claim 16, wherein said means for translatory movement comprises a rack integral with each section of said fixed frame and respective cog-wheels joined to a tubular element supporting said backrest.

18. The divan bed according to claim 16, wherein said means for locking said backrest comprise at least one hook which can be actuated by a lever against a recall action of resilient means and is designed to engage with at least one transverse pin fixed to a section.

* * * * *

UNITED STATES PATENT AND TRADEMARK OFFICE

CERTIFICATE OF CORRECTION

PATENT NO. : 6,397,411 B1
DATED : June 4, 2002
INVENTOR(S) : Rosario Messina

It is certified that error appears in the above-identified patent and that said Letters Patent is hereby corrected as shown below:

Column 6,
Line 6, "section" should read -- sections --

Signed and Sealed this

Tenth Day of December, 2002

JAMES E. ROGAN
*Director of the United States Patent and Trademark Office*